United States Patent [19]

Van Den Berg et al.

[11] Patent Number: 4,708,563

[45] Date of Patent: Nov. 24, 1987

[54] ARRANGEMENT FOR STORING PIPES

[75] Inventors: Frans J. Van Den Berg; Robert A. Viergever, both of Vlissingen, Netherlands

[73] Assignee: B.V. Koninklijke Maatschappij "De Schelde", Netherlands

[21] Appl. No.: 774,245

[22] Filed: Sep. 9, 1985

[30] Foreign Application Priority Data

Sep. 7, 1984 [NL] Netherlands ..... 8402734

[51] Int. Cl.[4] ..... E21B 19/14

[52] U.S. Cl. ..... 414/22; 175/52; 211/70.4; 414/745

[58] Field of Search ..... 414/22, 745, 747; 175/5, 52, 85; 211/70.4

[56] References Cited

U.S. PATENT DOCUMENTS

| | | | |
|---|---|---|---|
| 3,333,562 | 8/1967 | Deal et al. | 175/5 X |
| 3,785,506 | 1/1974 | Crocker et al. | 414/22 X |
| 3,870,165 | 3/1975 | Besijn | 414/22 |
| 3,981,369 | 9/1976 | Bokenkamp | 414/22 X |
| 3,985,189 | 10/1976 | Jahnke et al. | 414/22 X |
| 4,044,895 | 8/1977 | Adair | 414/22 |
| 4,117,941 | 10/1978 | McCleskey et al. | 414/22 |

FOREIGN PATENT DOCUMENTS

| | | | |
|---|---|---|---|
| 84/01599 | 4/1984 | PCT Int'l Appl. | 175/85 |

*Primary Examiner*—Leslie J. Paperner

[57] ABSTRACT

An arrangement for storing pipes in an offshore drilling installation below an upper deck carrying a derrick with associated equipment; comprising a pipe magazine below the upper deck, a horizontal transport means for the individual displacement of riser pipe sections between an aperture in the upper deck and storage means formed by a plurality of racks arranged along the path of the horizontal transport means, each carrying a plurality of pipe sections in vertical position. Each rack, as a turret, is rotatable about a vertical axis so that each pipe section, through rotation of the turret concerned, can be brought within reach of the horizontal transport means. The horizontal transport means comprises at least one assembly of a lower carrier trolley and an upper guide trolley movable, superimposed, along rails provided on the magazine floor, and below the deck, respectively. In the magazine, underneath the aperture in the derrick floor, there is provided a ramp tiltable between a vertical position aside the aperture and a position inclined with the top towards the aperture, with two carriages movable along the ramp, each having a pipe-engaging arm for gripping a portion of a pipe section.

6 Claims, 5 Drawing Figures

ARRANGEMENT FOR STORING PIPES

The present invention relates to an arrangement for storing pipes in an offshore drilling installation whose upper deck, above a portion forming the derrick floor, carries a derrick with appurtenant equipment, such as hoisting means with lowering tools, and a rotary table is mounted in the derrick floor, which pipe storage arrangement comprises a pipe magazine extending adjacent to, and laterally of, the rotary table underneath the derrick floor, said magazine containing means for vertically storing riser pipe sections, as well as a horizontal transport means for the individual displacement of riser pipe sections between the storage means and a zone situated underneath the derrick floor, as disclosed in U.S. Pat. No. 3,981,369.

In such offshore drilling installations, such as drilling platforms of the semi-submersible type, comprising a platform supported by a plurality of floating columns above the water surface or drilling vessels, the connection between the drilling installation and the well head installed on the sea bottom is effected by a riser pipe for the transport of the drilling string, drilling mud and various tools between the platform and the drill hole. The riser pipe includes a plurality of sections interconnected at their ends by joints in watertight relationship.

In the case of bad weather or of approaching icebergs, it is necessary to sever the connection between drilling installation and drill hole in the shortest possible time, while the riser pipe is released from the well head and is lifted section by section by the hoisting means of the derrick. Uncoupled riser pipe sections are engaged below the derrick floor by the horizontal transport means and transported to a place in the storage means. Such a below-deck riser pipe storage has a number of advantages over the conventional storage of pipes lying adjacent the derrick. In case of below-deck storage, the centre of gravity of the installation is kept relatively low. No useful space on deck is used and no material has to be transported through a port aside through the derrick structure, so that the derrick can remain closed on all sides, which is important in arctic regions.

The prior art apparatus, however, also has a number of drawbacks: the storage means for the riser pipe sections comprise so-called finger decks mounted in the top of the magazine, i.e. cantilevered parallel bars between which the tube sections are suspended in rows in tandem relationship. The lower ends of the suspended tube sections are positioned by projections extending into the sections and fixed onto the magazine floor and the sections in each row are kept spaced apart by retaining beams extending transversely to the finger deck bars. This arrangement excludes the removal of a random riser tube section from the storage without displacement of other sections. A convenient accessibility of random riser tube sections is important since, unlike a drilling string, a riser pipe mostly consists of differently designed or differently fitted sections. Depending on the water depth, thicker, double-walled sections, or section fitted with jackets of float material can be employed. Besides, the horizontal transport means for the prior art pipe storage consists of a crane movable along overhead rails and engaging the sections at their top ends. The suspension of the riser pipe sections in the storage and the use of a gantry crane require a heavy roof construction along the entire length of the magazine, i.e. strong enough to carry the crane plus a riser pipe section and such a roof construction impedes the accessibility of the magazine from the top. Furthermore, maintenance and inspection of the end joints of stored sections is difficult. With a view to the weight of riser pipe sections, the finger deck and the retaining beams should be heavy and thus occupy substantial space.

It is an object of the present invention to eliminate these drawbacks.

To this end according to the present invention, the storage means are formed by a plurality of racks arranged along the path of the horizontal transport means, each carrying a plurality of tube sections, in which racks the tube sections are each directly accessible for the horizontal transport means. Preferably, each rack is rotatable, as a turret, about a vertical axis, so that each pipe section can be brought within reach of the horizontal transport means by rotation of the turret concerned and be transported without the necessity for other pipes to be removed from their storage site.

For that purpose, for the storage of pipe sections provided with a collar at an interspace from their ends, e.g. for assembly of floats and for attaching control lines, according to the present invention, each rack includes arms for supporting vertically disposed pipe sections horizontally by engagement of the collars. This manner of support keeps the end joints of the pipe sections free for inspection and maintenance.

Moreover, the pipes in each rack are fixed laterally without requiring heavy finger decks and retaining beams and it is possible to store more pipes per unit of surface area.

The horizontal transport means according to the present invention may comprise at least one assembly of a lower carrier trolley and an upper guide trolley which are movable, superimposed, along rails disposed on the magazine floor, and underneath the deck, respectively, while each trolley may be provided with a lifting arm rotatable about a vertical axis and pivotal in a vertical plane.

A riser pipe section can be engaged by the arms of the trolleys and be transported, while the weight of the pipe section rests on the lower trolley and the upper trolley moving synchronously has a guiding function. The orientation of a riser pipe section can be influenced during transport by an independent rotation control of the lifting arm of the upper guide trolley.

As both in the racks and during horizontal transport, the heavy riser pipe sections rest exclusively on the magazine floor and the roof is not loaded, a heavy floor of the magazine will be sufficient and heavy roof constructions can be dispensed with. Allowance can be made for longer pipe sections in the floor construction, which expedites the pulling and emplacing of a riser pipe. Irrespective of the financial advantage of the increase in drilling time and the relatively small amount of joints, this has the additional advantage that in case of bad weather forecasts, it can be decided to discontinue the drilling process and to haul in the riser pipe at a later point of time and on better motives.

The rotatable turret construction offers the possibility to position it so that, through rotation of a turret, each of the pipe sections carried by it can be brought within the zone situated between the carrier trolley rails. When a riser pipe is taken over, the centre of gravity of the trolley then always remains between the rails, so that a simple wheel construction without particular guides for preventing tilting movements will be sufficient.

By having the magazine extend underneath the derrick floor horizontally in two directions and according to the present invention having a horizontal transport means be operative in each of the magazine portions, the supply and discharge of riser pipe sections and hence the riser pipe assembly and disassembly can be expedited.

U.S. Pat. No. 4,044,895 discloses a vertical transport means for a substantially below-deck drill pipe section magazine, which transport means in the magazine below an aperture in the derrick floor, comprises a ramp which is tiltable between a vertical position aside the rotary table and a position inclined with the top end towards the rotary table opening. A pipe section lifted from a finger deck by a horizontal transport means and supplied to the ramp, after transfer onto the vertical ramp, is tilted thereby with its top end towards the centre of the derrick floor, so that the entire pipe section is oriented towards the crown block of the derrick and the pipe section can be lifted along the ramp when the top end is engaged by a hoisting clamp.

It is an object of the present invention to provide such a vertical transport means that is better suitable for heavy riser pipe sections and for automatically assembling and disassembling a riser pipe.

To this end, the vertical transport means according to the present invention is characterized by two carriages movable along the ramp, each having an engagement arm for a collar of a pipe section and having such a path of movement that a pipe section supported by both carriages can be positioned with the top end within the reach of the hoisting equipment and the lower carriage can accompany the lower end of the pipe section to adjacent the derrick floor, where said pipe lower end can be engaged by a manipulator for positioning above the rotary table wherein the top end of a preceding pipe section has been arrested temporarily. The two pipe sections can then be jointed, while the ramp tilts again towards the vertical position and takes up a following pipe section meanwhile supplied by the horizontal transport means.

Due to the independent operation of the horizontal and vertical transport in the magazine, the supply and discharge rate can be accelerated. The process can be automated entirely and the function of the crew can be restricted practically entirely to supervision.

Since the riser pipe sections are pulled from the magazine through a (closable) passage to above the derrick floor and the formation of the riser pipe takes place through the passage underneath the rotary table in the platform adjacent the magazine, no provisions are required in the magazine for the formation and downward passage of the riser pipe via the magazine floor, as is the case in the apparatus according to U.S. Pat. No. 3,981,369. Consequently, the bottom of the magazine may be submersed and longer riser pipe sections can be stored with the advantages enumerated in the foregoing.

One embodiment of the arrangement for storing pipes according to the present invention will now be described, by way of example, with reference to the accompanying drawings, in which.

Figure 1:
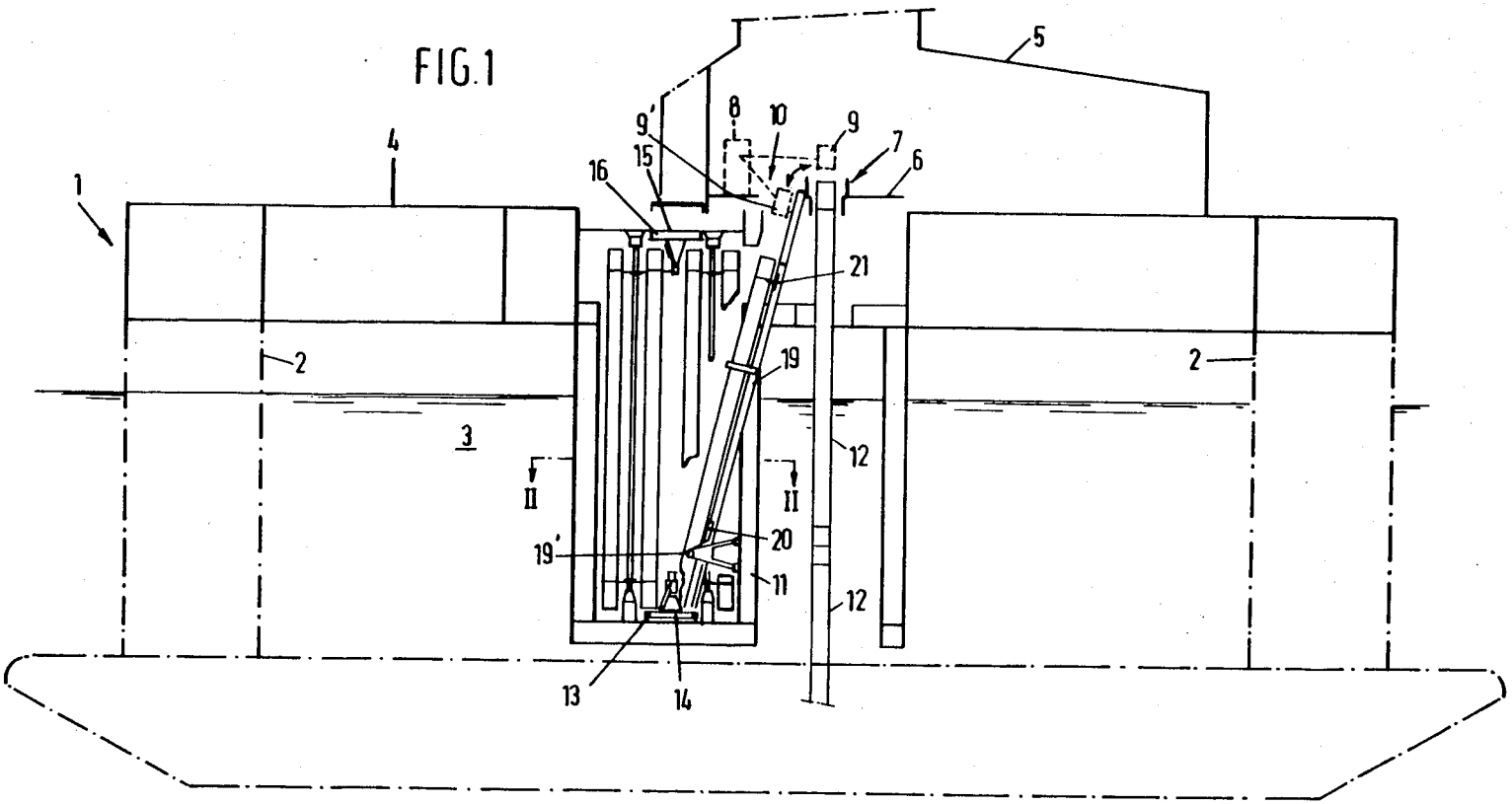
FIG. 1 is a diagrammatical, partly cross-sectional side view of a drilling installation of the semi-submersible type, comprising a riser pipe section storage arrangement according to the present invention.

As shown in the drawings, in particular FIG. 1, the offshore drilling installation comprises a platform 1 kept above the water level by columns 2. On the upper deck 4 there is mounted a derrick 5 with a rotary table 7 in the derrick floor 6. On the derrick floor there is also installed a pipe manipulator 8, diagrammatically shown, having a claw 9 movable between a pipe engagement position 9' in an opening 10 in the derrick floor 6 and a centering position 9 above the rotary table 7. It is possible by means of the pipe manipulator 8, in a manner to be described hereinafter, to engage the lower end of a pipe section 12 suspended from its top end and lifted from a magazine 11 from underneath the derrick floor 6, through the opening 10, and to centre the same above the rotary table 7 for jointing the same to a riser length formed from preceding riser pipe sections 12.

Figure 2:
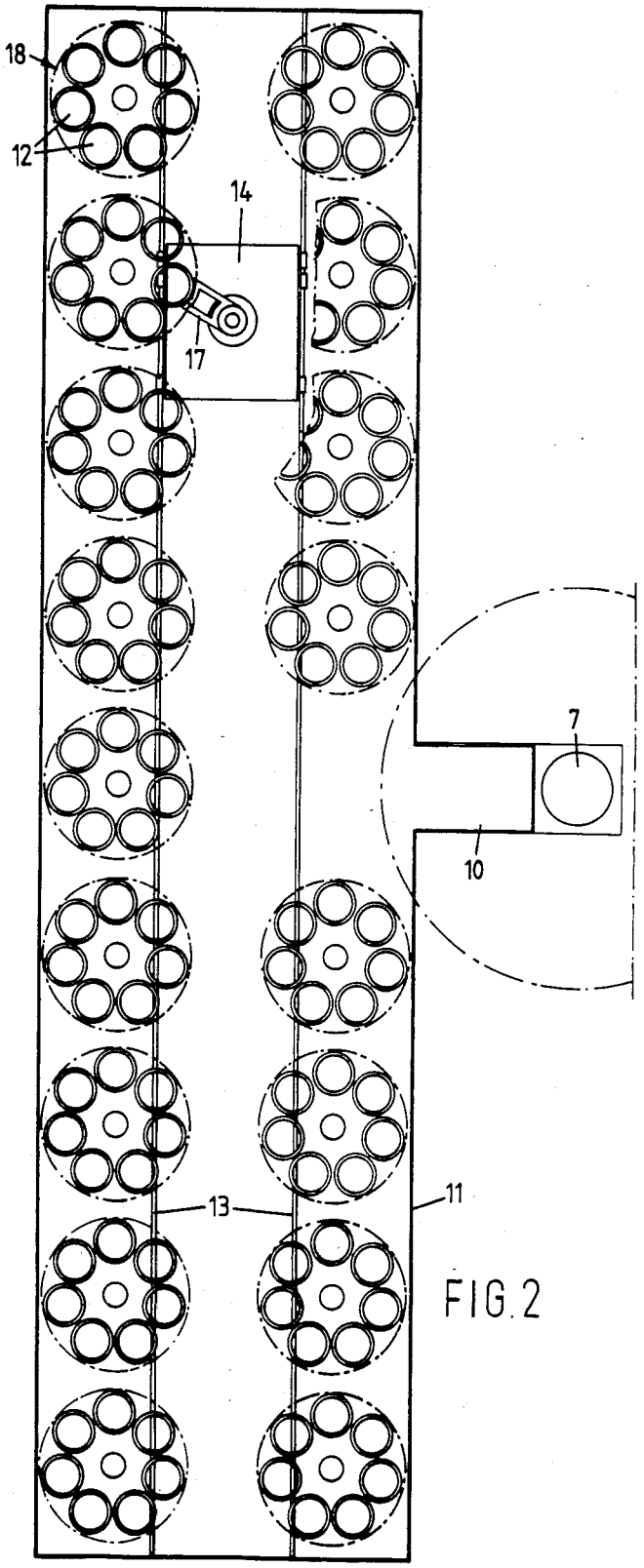
FIG. 2 is a cross-section on the line II—II of FIG. 1, with the vertical transport being omitted.

As illustrated in the cross-sectional top view of FIG. 2, the pipe magazine 11 extends from underneath the derrick floor in two directions. Through the entire magazine there extends a horizontal transport means of which FIG. 2 shows rails 13 for a carrier trolley 14. Trolley 14, of which only one is depicted and of which one can be operative, however, in each magazine portion, coacts with the guide trolley 15 movable in synchronism with the carrier trolley 14 along rails 16 on the roof of the magazine 11. Each trolley 14, 15 includes an arm 17 rotatable all around and vertically pivotable for engaging a pipe section.

Along the rails 13, 16 there are arranged in the magazine 11 pipe storage racks in the form of turrets 18, each for vertically storing a plurality of riser pipe sections 12 in such a manner that, through rotation of a turret, each of the pipe sections stored therein can be brought to within the rails 13, hence above a trolley 14 moved adjacent said turret, within reach of the arms 17.

In this manner, each randomly stored riser pipe section can be engaged by the trolley assembly 14, 15 without the necessity of moving other pipe sections, be brought at the opening 10 in the derrick floor, and be transferred onto the vertical transport means, including according to FIG. 1 a ramp 19 pivotable between a vertical position and an inclined position illustrated in FIG. 1. A pipe section placed on ramp 19 rests on two carriages 20, 21 adapted to lift the section. As soon as the top end of the section 12 projects above the derrick floor 6, this can be engaged by the hoisting means, not shown, of the derrick 5. During the further hoisting of section 12, this is released from the upper carriage 21, while the lower carriage guides the pipe section. As soon as the lower end of the pipe section has arrived within reach of the manipulator 8 (claw position 9') the manipulator takes over the guidance of the pipe section of the vertical transport 19–21 and, together with the hoisting means, ensures the centered positioning of the entire section above the rotary table 7.

Figure 3:
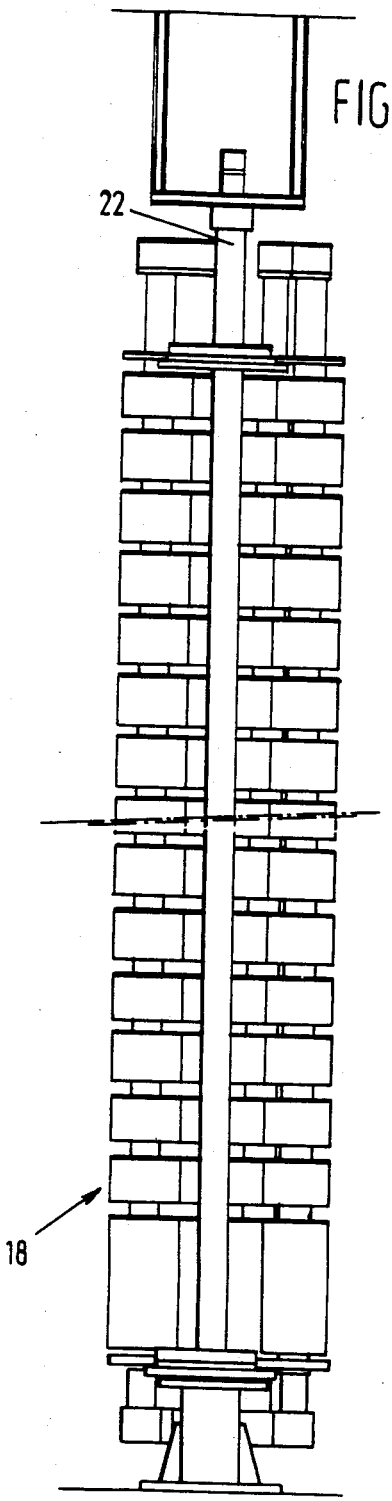
FIG. 3 is a side view in more detail of a riser pipe section storage turret.
Figure 4:
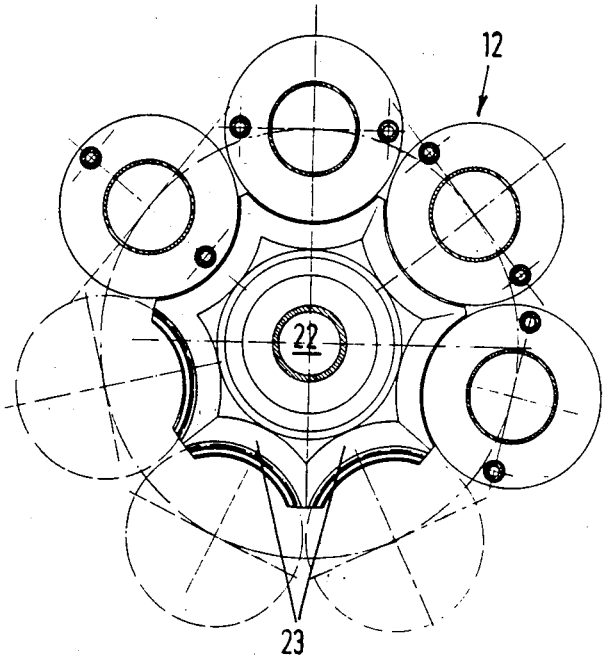
FIG. 4 is a cross-section on the line IV—IV of FIG. 3.
Figure 5:
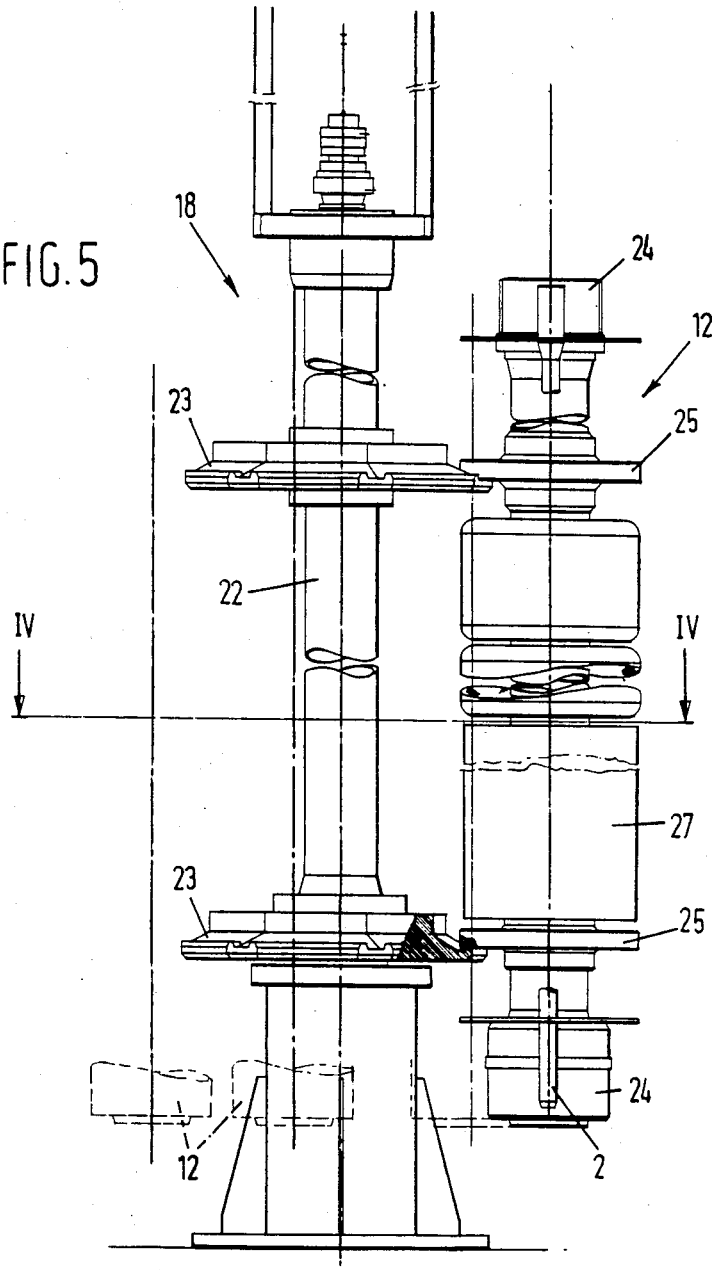
FIG. 5 shows the suspension of a riser pipe section in a turret.

With reference to FIGS. 3–5, the turrets 18 will now be discussed in more detail.

Each turret 18 includes a rotary spindle 22 carrying at two different levels a ring of carrier arms 23.

In the embodiment shown, each row includes seven carrier arms 23, so that each turret 18 may store seven riser pipe sections.

As shown in FIG. 5, each riser pipe section includes end joints 24 and at a short interspace therefrom flanges 25 for fixing lines 26 exteriorly of the sections 12. Between flanges 25, sleeves 27 of float material may be fitted on the riser pipe. The riser pipe sections rest through flanges 25 on the carrier arms 23 of the turrets 18. They can be placed on carrier arms 23 by the rotary and pivotal carrier arms 17 of the carrier trolley 14, while the corresponding arm 17 of the upper guide trolley 15 is operative directionally.

The foregoing describes the transport of a riser pipe section from the storage to the rotary table during the assembly of a riser pipe section. It is clear that all operations for pulling a riser pipe should be effected in reverse sequence, with the lower carriage 20 of the ramp 19 having a braking effect, so that the riser pipe sections on ramp 19 are guided positively both upwardly and downwardly.

Besides, the pipe sections 12 may be suspended in the magazine 11 from carrier arms 23 not forming part of turrets but e.g. of pivotal sectors or of fixed ribs.

We claim:

1. An arrangement for storing pipes in an offshore drilling installation whose upper deck, above a portion forming the derrick floor, carries a derrick with appurtenant equipment, such as hoisting means with lowering tools, and a rotary table is mounted in the derrick floor, which pipe storage apparatus comprises a pipe magazine extending adjacent to, and laterally of, the rotary table underneath the derrick floor, said magazine containing means for vertically storing riser pipe sections, as well as a horizontal transport means for the individual displacement of riser pipe sections between the storage means and a zone situated underneath the derrick floor, characterized in that the storage means are formed by a plurality of turrets arranged along the path of the horizontal transport means, each carrying a plurality of riser pipe sections in a single circumferential row with each pipe section being adapted to be individually designed as necessary to be part of an offshore drilling riser pipe, each turret being rotatable about a vertical axis so that each riser pipe section, through rotation of the turret concerned, can be brought within reach of the horizontal transport means for assembling an offshore drilling riser pipe consisting of differently designed or differently fitted sections by selecting various individual pipe sections from storage as necessary to assemble such offshore drilling riser pipe.

2. An arrangement according to claim 1, for the storage of pipe sections, each provided with a collar spaced from their ends, characterized in that each turret includes arms for supporting a pipe section vertically and horizontally by engagement of the collars.

3. An arrangement according to any one of the preceding claims, characterized in that the horizontal transport means comprises at least one assembly of a lower carrier trolley and an upper guide trolley movable, superimposed, along rails provided on the magazine floor, and below the deck, respectively, each trolley including a lifting arm rotatable about a vertical axis and pivotable in a vertical plane.

4. An arrangement according to claim 3, characterized in that the turrets are positioned in such a manner that, through rotation of a turret, each of the pipe sections carried by it can be brought within the zone situated between the carrier trolley rails.

5. An arrangement according to any one of the preceding claims 1 or 2, in which the magazine extends underneath the derrick floor horizontally in two directions, characterized in that a horizontal transport means is operative in each of the magazine portions.

6. An arrangement for storing pipes in an offshore drilling installation whose upper deck, above a portion forming the derrick floor, carries a derrick with appurtenant equipment, such as hoisting means with lowering tools, and a rotary table is mounted in the derrick floor, which pipe storage apparatus comprises a pipe magazine extending adjacent to, and laterally of, the rotary table underneath the derrick floor, said magazine containing means for vertically storing riser pipe sections, as well as a horizontal transport means for the individual displacement of riser pipe sections between the storage means and a zone situated underneath the derrick floor and further including a vertical transport means in the magazine underneath an aperture in the derrick floor and a ramp tiltable between a vertical position aside a rotary table opening and a position inclined with the top towards the rotary table opening, characterized in that the storage means are formed by a plurality of turrets arranged along the path of the horizontal transport means, each carrying a plurality of pipe sections in a single circumferential row, each turret is rotatable about a vertical axis so that each pipe section, through rotation of the turret concerned, can be brought within reach of the horizontal transport means, and two carriages movable along the ramp, each having a pipe-engaging arm for gripping a collar of a pipe section and having such a path of movement that a pipe section supported by the two carriages can be positioned with the top end within reach of the hoisting equipment and the lower carriage can guide the bottom end of the pipe section to adjacent the derrick floor.

* * * * *